United States Patent [19]

Theiss

[11] 4,079,771

[45] Mar. 21, 1978

[54] DRAPE MOVING DEVICE

[75] Inventor: Blanche M. Theiss, Williamstown, N.J.

[73] Assignee: The Raymond Lee Organization, Inc., New York, N.Y. ; a part interest

[21] Appl. No.: 772,117

[22] Filed: Feb. 25, 1977

[51] Int. Cl.[2] ..... A47H 1/00

[52] U.S. Cl. ..... 160/90; 160/102

[58] Field of Search ..... 160/87, 89, 90, 91, 160/92, 95, 96, 102, 103, 127; 49/65, 163

[56] References Cited

U.S. PATENT DOCUMENTS

| | | | |
|---|---|---|---|
| 923,153 | 6/1909 | Dennhardt | 160/102 |
| 1,662,049 | 3/1928 | Abel | 160/92 |
| 2,755,520 | 7/1956 | Pesonen | 160/90 |

*Primary Examiner*—Peter M. Caun

*Attorney, Agent, or Firm*—Daniel Jay Tick

[57] ABSTRACT

A bracket type member is affixed to a sliding door at a first end thereof and extends upward in a plane perpendicular to the door whereby the second end of the member is above the first end and spaced from the door and extends between an end ring of a drape hanging from a rod extending above, parallel to, and spaced from, the door, and the ring next-adjacent thereto. The member thus moves the drape in the same direction as the door.

2 Claims, 4 Drawing Figures

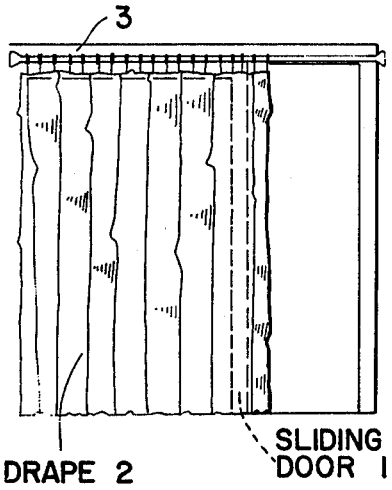
FIG. 1
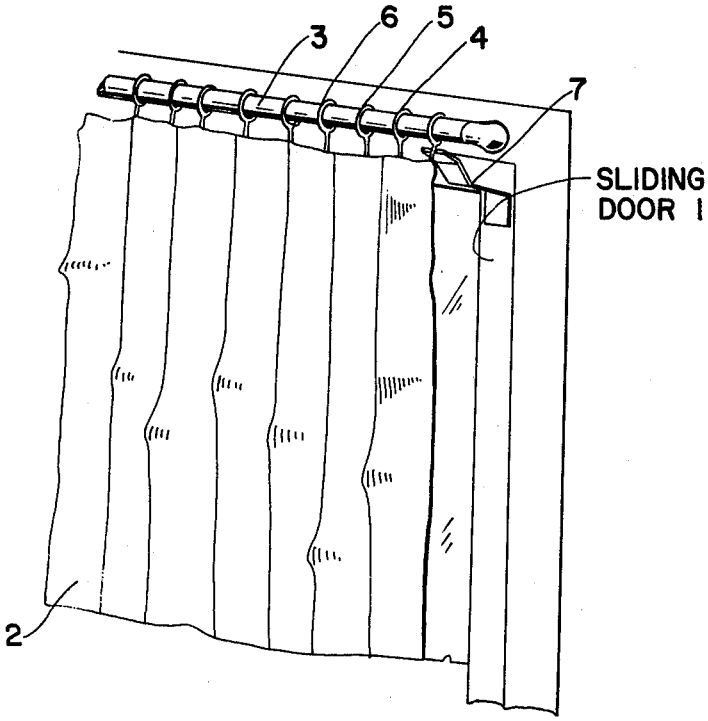
FIG. 2
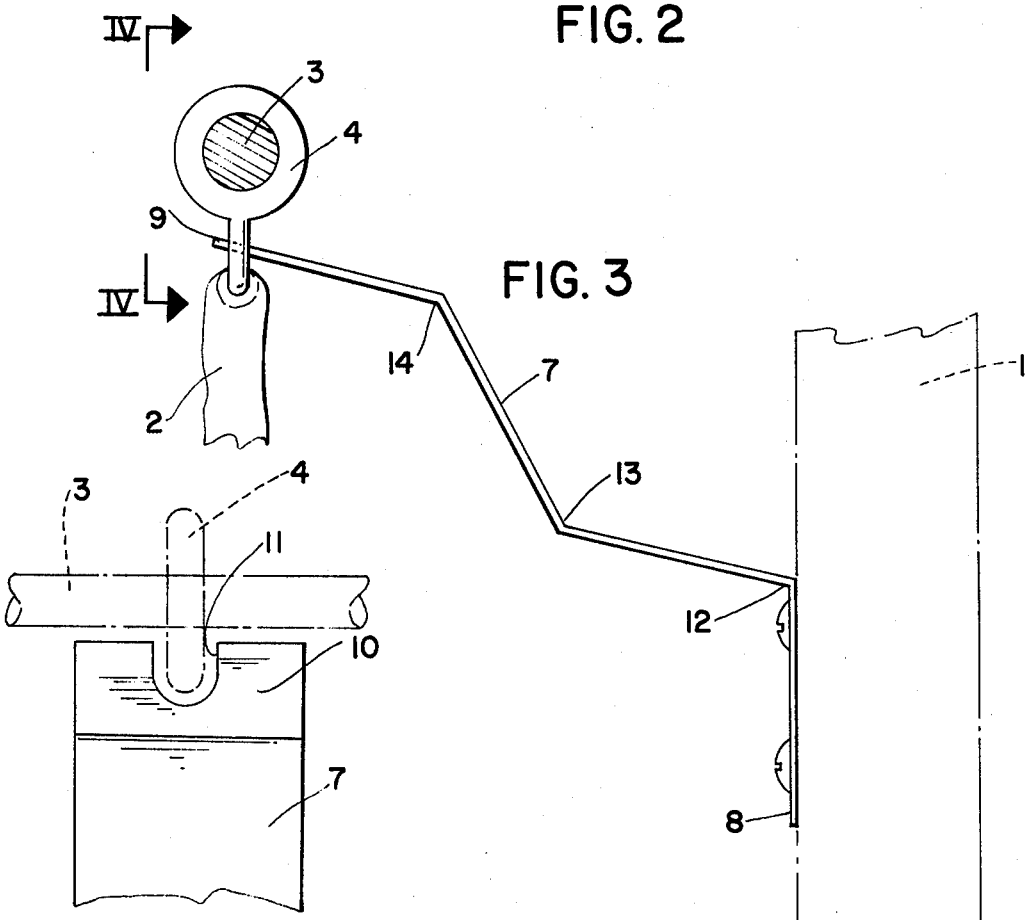
FIG. 3
FIG. 4

DRAPE MOVING DEVICE

BACKGROUND OF THE INVENTION

The present invention relates to a drape moving device. More particularly, the invention relates to a drape moving device for a sliding door mounted to slide in a plane parallel to a drape hanging substantially parallel to such plane from a rod extending above, parallel to, and spaced from, the door, and spaced from and parallel to such plane via a plurality of rings each affixed to the drape and slidably mounted on the rod.

Objects of the invention are to provide a drape moving device of simple structure, which is inexpensive in manufacture, installed with facility and convenience on new and existing sliding doors, and functions efficiently, effectively and reliably to move a drape hanging adjacent the door with such door, so that the drape is opened and closed with the opening and closing of the door.

BRIEF DESCRIPTION OF THE DRAWINGS

In order that the invention may be readily carried into effect, it will now be described with reference to the accompanying drawings, wherein:

FIG. 1 is a view illustrating the operation of the drape moving device of the invention;

FIG. 2 is a perspective view of an embodiment of the drape moving device of the invention mounted on a door;

FIG. 3 is a side view, on an enlarged scale, of the embodiment of FIG. 2; and FIG. 4 is a view, taken along the lines IV—IV, of FIG. 3.

DETAILED DESCRIPTION OF THE INVENTION

The drape moving device of the invention is for a sliding door 1 (FIGS. 1 to 3) mounted to slide in a plane parallel to a drape 2 hanging substantially parallel to said plane from a rod 3 extending above, parallel to, and spaced from, the door, as shown in FIGS. 1 to 3. The drape 2 hangs in a plane spaced from and parallel to the plane of movement of the door via a plurality of rings 4, 5, 6, and so on (FIG. 2) each affixed to said drape. The rings 4, 5, 6, and so on, are slidably mounted on the rod.

The drape moving device of the invention comprises a bracket type member 7 (FIGS. 2 to 4) having spaced opposite first and second ends 8 and 9 (FIG. 3). The bracket type member 7 is affixed to the door 1 at the first end 8 thereof and extends upward in a plane substantially perpendicular to said door whereby the second end 9 of said member is above said first end and spaced from the door, as shown in FIGS. 2 and 3. The second end 9 of the bracket type member 7 extends between an end ring 4 of the drape and the ring 5 next-adjacent thereto whereby said bracket type member moves the drape 2 in the same direction as the door, so that the drape opens and closes when the door is opened and closed, respectively.

The bracket type member 7 has a free edge 10 at its second end 9 and a groove 11 formed in said free edge for accommodating a ring such as, for example, the end ring 4 of the drape, as shown in FIG. 4. The bracket type member 7 is thus positionable with the groove 11 around part of the end ring 4 of the drape to move said drape in the same direction as the door. This accomplishes the same results as when the second end 9 of the member 7 is positioned between the rings 4 and 5.

If it is desired to disengage the bracket type member from the drape, said bracket type member may be bent so that it no longer is in contact with any of the rings of the drape, or the end ring may merely be lifted off the bracket member 7 so that said bracket member is disengaged from the rings of the drape.

As shown in FIG. 3, the bracket type member is bent at obtuse angles three times. The first bend 12 of the member 7 is at an angle of approximately 100° between the adjacent parts and opens downward. The next end 13 of the member 7 is at an angle of approximately 130° and opens upward. The third bend 14 of the member 7 is at an angle of approximately 140° between the parts and opens downward.

While the invention has been described by means of a specific example and in a specific embodiment, I do not wish to be limited thereto, for obvious modifications will occur to those skilled in the art without departing from the spirit and scope of the invention.

I claim:

1. A drape moving device for a sliding door mounted to slide in a plane parallel to a drape hanging substantially parallel to said plane from a rod extending above, parallel to, coextensive with, and spaced from, the door, and spaced from and parallel to said plane via a plurality of rings each affixed to the drape and slidably mounted on the rod, said drape moving device comprising a bracket type member having spaced opposite first and second ends, affixed to the door at the first end thereof and extending upward in a plane substantially perpendicular to said door in a manner whereby the second end of said bracket type member is above said first end and spaced from the door and extends between an end ring of the drape and the ring next-adjacent thereto in a manner whereby said second end engages at least one of said rings whereby said bracket type member moves the drape in either direction as the door is moved.

2. A drape moving device as claimed in claim 1, wherein the bracket type member has a free edge at its second end and a groove formed in said free edge for accommodating a ring of the drape whereby said bracket type member is positionable with the groove around part of an end ring of the drape to move the drape in the same direction as the door.

* * * * *